US005728036A

United States Patent [19]

Kagan et al.

[11] Patent Number: 5,728,036

[45] Date of Patent: Mar. 17, 1998

[54] ELONGATED FINNED BACKUP ROLLERS HAVING MULTIPLE MAGNETIZED FINS FOR GUIDING AND STABILIZING AN ENDLESS, FLEXIBLE, HEAT-CONDUCTING CASTING BELT

[75] Inventors: Valery G. Kagan; R. William Hazelett, both of Colchester, Vt.

[73] Assignee: Hazelett Strip-Casting Corporation, Colchester, Vt.

[21] Appl. No.: 677,882

[22] Filed: Jul. 10, 1996

[51] Int. Cl.[6] ..... G03G 19/00; B22D 11/06

[52] U.S. Cl. ..... 492/8; 492/36; 492/39; 164/431; 164/502

[58] Field of Search ..... 164/431–434, 164/466, 502, 146, 423, 463, 481, 482; 492/8, 36, 39, 30

[56] References Cited

U.S. PATENT DOCUMENTS

| | | | |
|---|---|---|---|
| 4,506,725 | 3/1985 | Bedell | 164/502 |
| 5,086,827 | 2/1992 | Graham et al. | 164/431 |
| 5,392,702 | 2/1995 | Suzuki | 492/8 |

FOREIGN PATENT DOCUMENTS

| | | | |
|---|---|---|---|
| 2709540 | 9/1978 | Germany . | |
| 2729339 | 1/1979 | Germany . | |
| 2729425 | 1/1979 | Germany . | |
| 2729431 | 1/1979 | Germany . | |
| 1-127152 | 5/1989 | Japan | 164/431 |

*Primary Examiner*—Joseph J. Hail, III
*Assistant Examiner*—I.-H. Lin
*Attorney, Agent, or Firm*—G. Kendall Parmelee; Parmelee & Bollinger, LLP

[57] ABSTRACT

Elongated finned backup rollers have multiple magnetized fins for rolling contact with a moving endless, flexible, thin-gauge, heat-conducting, magnetically soft ferromagnetic casting belt for guiding and stabilizing the belt against thermal distortion while it moves along the mold cavity being heated at its front surface by heat from molten metal while being cooled at its reverse surface by flowing liquid coolant. Each finned backup roller includes an elongated, non-magnetic shaft rotatable around its axis and having multiple annular fins of magnetically soft ferromagnetic material fitted onto the shaft spaced along the shaft. The fins have circular perimeter rims for rolling contact with the reverse surface of a belt. Intervening collar shaped reach-out permanent magnets are mounted on the shaft between successive fins. The fins and reach-out collar magnets alternate in sequence along the length of the roller. The reach-out collar magnets are magnetized in a direction parallel with the axis of the roller. Thus, fins become magnetized by the magnets with their perimeters having alternate North and South magnetic polarities in sequence along the roller. In addition to attraction of the belt by magnetic flux which passes through small localized rim-contact regions where fin rims are rolling on the belt surface, the belt also is attracted toward the fins by reach-out magnetic flux extending out in three-dimensional patterns toward the belt from the rim and also from tapered side surfaces of each fin.

20 Claims, 3 Drawing Sheets

ELONGATED FINNED BACKUP ROLLERS HAVING MULTIPLE MAGNETIZED FINS FOR GUIDING AND STABILIZING AN ENDLESS, FLEXIBLE, HEAT-CONDUCTING CASTING BELT

FIELD OF THE INVENTION

The present invention is in the field of continuous casting of molten metal by pouring it into belt-type casting machines using one or more endless, flexible, moving heat-conducting casting belts, e.g., metallic casting belts, for defining a moving mold cavity or mold space along which the belt or belts are continuously moving with successive areas of each belt entering the mold cavity, moving along the mold cavity and subsequently leaving the moving mold cavity. The product of such continuous casting is normally a continuous slab, plate, sheet or strip or a generally rectangular continuous bar.

More particularly this invention relates to finned backup rollers having multiple fins formed of magnetically soft ferromagnetic material which are magnetized by multiple permanent magnets included in the rollers themselves and providing reach-out magnetic attraction to a moving, flexible, thin-gauge, heat-conducting, magnetically soft ferromagnetic casting belt for guiding and stabilizing the belt against thermal distortion while it is moving along the mold cavity being heated at its front surface by heat coming from molten metal while being cooled at its reverse surface by flowing pumped liquid coolant.

BACKGROUND OF THE INVENTION

During the continuous casting of molten metal in a machine using at least one moving, flexible, thin-gauge, heat-conducting casting belt, e.g., a metallic casting belt, it is vitally important that the moving belt remain travelling along a predetermined desired path requiring substantial evenness or flatness of the belt itself despite the presence of hot metal and resultant thermal stresses induced in the belt by intense heat from hot metal entering its front surface while its reverse surface is being cooled by suitable liquid coolant. The continuous casting of molten metals in a machine using at least one such casting belt often has been affected by thermally-induced warping, buckling, fluting or wrinkling (herein called "distortions") of the casting belt. Hazelett et al. in U.S. Pat. Nos. 3,937,270; 4,002,197; 4,062,235; and 4,082,101 in FIG. 8 of each Patent and Allyn et al. in FIG. 5 of U.S. Pat. No. 4,749,027 illustrate thermally-induced transverse bucking and fluting occurring in such a casting belt. Thermally-induced warping or wrinkling also has occurred in such belts. These belt distortions can occur quite suddenly, like a sudden popping of a lid on an evacuated container when the lid initially is opened and air rushes into the container. Moreover, these distortions can be erratic and unpredictable as to their extent and their particular locations in a casting belt which is intended to be even, without distortions, as it moves along the mold cavity.

Such thermally-induced distortions are more likely to occur near an input region of the mold cavity where the moving casting belt first experiences intense heating effects of hot molten metal introduced into or soon after its introduction into the moving mold cavity. Near the input region initial freezing of molten metal is occurring or commencing, and belt distortions during such freezing may result in a cast product containing slivers, stains or segregation of alloying constituents. turn, these defects in the cast product lead to problems of strength, formability, and appearance.

C. W. Hazelett in U.S. Pat. No. 2,640,235 (in Column 7) described upper and lower cooling assemblies for upper and lower chilling bands. These cooling assemblies were identical in operation, and each cooling assembly comprised a plate that may be of some suitable readily magnetized material which formed the soft core of an electromagnet. It was the function of a plate when rendered magnetic by flow of current to pull a band toward itself. To prevent this movement of the band toward the plate, copper or brass spacers were utilized, these spacers allowing a formation of chambers between the band and the plate. In these chambers cooling water was introduced to chill the band. Even though this cooling water was introduced at considerable pressure, and sufficient normally to distort the band, the specification stated it will not do so because of the influence of the magnetic plate holding the band firmly against the rigid spacers. In this way, the specification stated, it is possible to cool the band while guiding it and holding it against distortion, and thereby maintaining accurate gauge of the product.

William Baker et al. in U.S. Pat. No. 3,933,193 disclosed apparatus for continuous casting of metal strip between moving belts. The belts were held against closely spaced support surfaces by means of externally applied attractive forces achieved by sub-atmospheric pressure conditions on the reverse side of the belts or magnetic forces employed for the same purpose.

Olivio Sivilotti et al. in U.S. Pat. No. 4,190,103 (in Column 2, lines 38–44) stated: "Thus in a practical embodiment of the above-mentioned apparatus, the belt has been drawn against the faces of the closely spaced supports by subatmospheric pressure in the water-filled housing. An alternative arrangement was to provide magnetic means, acting through ferromagnetic supports on a ferromagnetic belt, to hold the belt in the desired path."

The assignee of the present invention, Hazelett Strip-Casting Corporation, experimentally has tried stationary electromagnetic belt-backup finned platens in sliding contact with the reverse surfaces of moving casting belts but without performance which was satisfactory enough to justify their continuance in view of excessive wear and friction. Moreover, these electromagnetic finned platens failed to reliably retain or stabilize the moving casting belt in flat condition.

SUMMARY OF THE DISCLOSURE

We have discovered that magnetic devices as described by C. W. Hazelett, Sivilotti et al., or Baker et al. in the foregoing patents did not come into industrial use in continuous casting of molten metal, because their magnetic attraction forces, i.e., pull exerted on the belt or band, diminished too rapidly and/or too abruptly as a function of spacings (gaps) between the casting belt or band and the magnetic devices which were intended to pull thermally distorted portions of the moving belt or band back toward themselves into a predetermined desired even condition. The magnetic attraction (pull) of these prior devices on a casting belt or band did not reach out across significant gaps and therefore did not suitably pull back portions of a belt or band which became significantly displaced from a desired even condition due to thermally-induced distortions. There was a failure or lack in what we call "reach-out attraction force", i.e., a failure or lack in "reach-out pull".

There was no disclosure nor suggestion by Baker et al. of the critical importance we have discovered in what we call "reach-out attraction forces" (i.e., "reach-out pull").

This powerful reach-out attraction force (pull) on a thin-gauge belt of magnetically soft ferromagnetic material is unlike the behavior of magnets made of traditional materials, even alnico 5, which materials lose much of their attraction force or pull when significant gaps, for example such as gaps of 1.5 mm (0.060 of an inch) occur between the belt and the magnetized fins in finned backup rollers as shown and described. Thus, fins which are magnetized by reach-out magnets are capable of pulling thermally distorting portions of the moving casting belt toward the rotating fins along which the belt is travelling for keeping the belt held within close limits in a predetermined desired stabilized even condition of the moving casting belt where the moving casting belt is supported and stabilized by the finned backup rollers against thermal distortion.

In our invention, this reach-out pull is provided by the unique permanent-magnetic materials described herein formed into reach-out permanent magnets arranged in magnetic circuits as described in finned backup rollers having multiple fins formed of magnetically soft ferromagnetic material. These fins are magnetized by multiple reach-out permanent magnets included in the rollers themselves for guiding and stabilizing a moving, flexible, thin-gauge, heat-conducting, magnetically soft ferromagnetic casting belt against thermal distortion while it is moving along the mold cavity being heated at its front surface by heat coming from molten metal while being cooled at its reverse surface by flowing pumped liquid coolant.

In accordance with the present invention in one of its aspects there are provided elongated finned backup rollers for guiding an endless, flexible, heat-conducting casting belt containing magnetically soft ferromagnetic material. Such a backup roller comprises multiple fins each having a circular circumference concentric with the axis of rotation of the roller. These fins are formed of magnetically soft ferromagnetic material and are mounted in the roller at positions spaced axially along the roller. The fins are magnetized with their circumferences having alternate North and South magnetic polarities in sequence along the roller, being magnetized by multiple permanent reach-out magnets mounted in the elongated roller with each magnet providing reach-out magnetic attraction forces extending from rims of the fins and extending from tapering side surfaces of the fins in three-dimensional patterns suitable for stabilizing the moving casting belt.

In an illustrative embodiment of the present invention a finned backup roller for guiding and stabilizing an endless, flexible, heat-conducting casting belt containing magnetically soft ferromagnetic material comprises an elongated, rotatable, non-magnetic shaft. Multiple annular fins of magnetically soft ferromagnetic material having circular perimeters are fitted onto the shaft with intervening collar-shaped reach-out permanent magnets located between successive fins. The fins and magnets alternate in sequence along the length of the roller, the fins being magnetized by the reach-out magnets with their circular perimeters having alternate North and South magnetic polarities in sequence along the roller.

The present invention successfully addresses or substantially overcomes or substantially reduces the above-mentioned persistent problems caused by thermally induced distortions of a moving, endless, flexible, thin-gauge, heat-conducting casting belt in a continuous casting machine.

As used herein the term "thin-gauge" as applied to a heat-conducting casting belt formed predominantly of steel is intended to mean a casting belt having a thickness less than about one-tenth of an inch (about 2.5 mm) and usually less than about 0.070 of an inch (about 2.0 mm).

Magnetic permeability of magnetically soft ferromagnetic material is defined as B/H wherein "B" is magnetic flux density in Gauss in a material and "H" is magnetic coercive force in Oersteds applied to the material. As used herein, the term "magnetically soft ferromagnetic material" means a material which has a maximum magnetic permeability of at least about 500 times the magnetic permeability of air or water or vacuum, each of which has a magnetic permeability of about 1. For example, ordinary transformer steel has a maximum magnetic permeability of about 5,450 as measured at a magnetic flux density B of about 6,000 Gauss with a magnetic coercive force H of about 1.1 Oersted, stated on page E-115 of the CRC Handbook of Chemistry and Physics, 66th Edition, dated 1985–1986. The phrase "magnetically soft" as used in this term "magnetically soft ferromagnetic material" means that such material is relatively easily magnetized or demagnetized. Thus, the adjective "soft" is herein being used in contradistinction to the adjective "hard" which is applied to magnetic materials requiring a large coercive force to become magnetized or demagnetized such that they are difficult to magnetize and demagnetize. Ordinary transformer steel and also the quarter-hard-rolled low-carbon sheet steel usually employed in forming thin-gauge casting belts for use in twin-belt continuous casting machines are within the category of "magnetically soft ferromagnetic material".

In ASTM Designation: A 340–93, Standard Terminology of Symbols and Definitions Relating to Magnetic Testinh, "residual induction, $B_r$" is defined "the value of magnetic induction corresponding to zero magnetizing field when the magnetic material is subjected to symmetrically cyclically magnetized conditions".

The permeability of a hard magnetic material is $\Delta B/\Delta H$ as measured in a useful portion of the demagnetization curve, which curve is in turn defined as that portion of the B-H hysteresis loop, i.e., the B-H loop or B-H curve, lying in the second (or fourth) quadrant of the normal hysteresis loop. "Normal hysteresis loop" is defined in the above ASTM Designation.

Other objects, aspects, features and advantages of the present invention will become understood from the following detailed description of the presently preferred embodiments considered in conjunction with the accompanying drawings, which are presented as illustrative and are not intended to limit the invention and which are not necessarily drawn to scale but rather are drawn for clarity of illustrating principles of the invention. Corresponding reference numbers are used to indicate like components or elements throughout the various Figures.

BRIEF DESCRIPTION OF THE DRAWINGS

FIG. 1 also shows end fittings for mounting in engagement with suitable bearings for the roller.

DETAILED DESCRIPTION OF PREFERRED EMBODIMENTS

Figure 1:
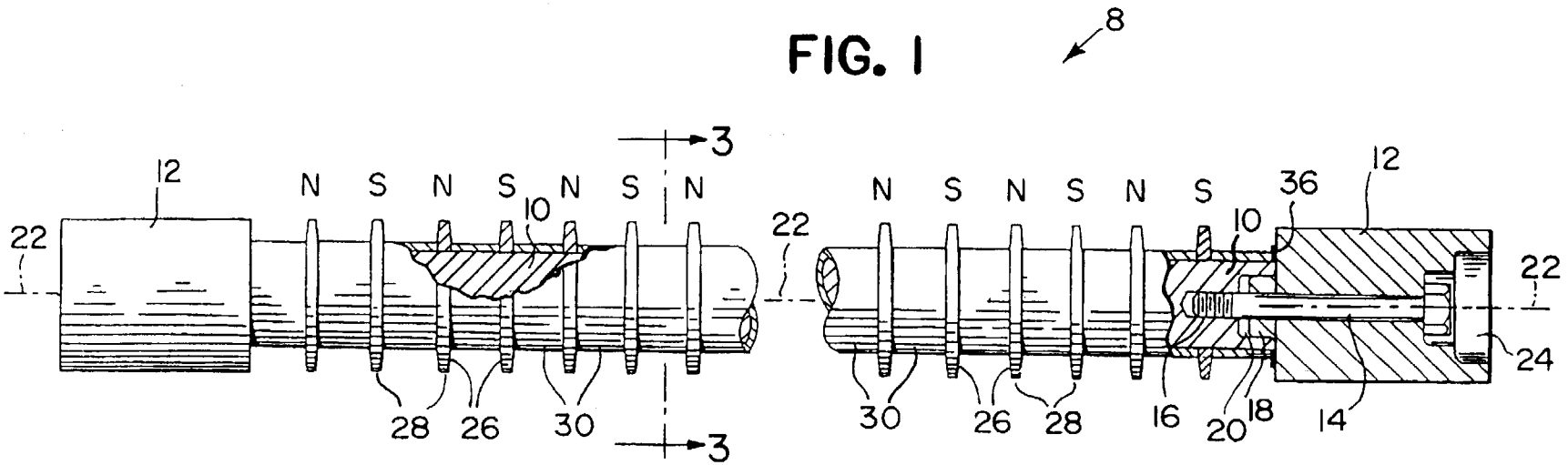
FIG. 1 is a side elevational and partial sectional view taken along line 1—1 in FIG. 2 showing an elongated finned backup roller having multiple magnetized fins for guiding and stabilizing an endless flexible casting belt.
Figure 2:
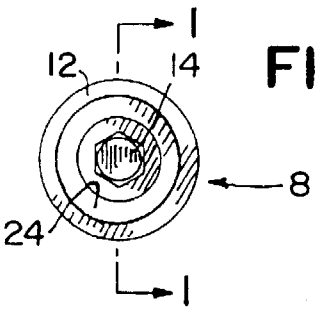
FIG. 2 is an end elevational view of an end fitting of the backup roller shown in FIG. 1.
Figure 3:
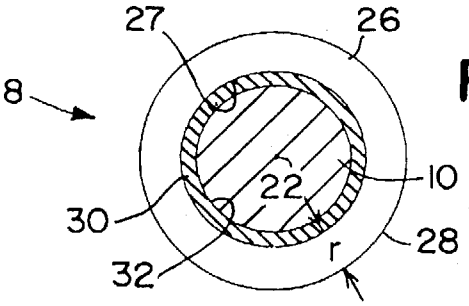
FIG. 3 is a cross-sectional view taken through the roller along plane 3—3 in FIG. 1.

The elongated finned backup roller 8 (FIGS. 1, 2 and 3) embodying the invention includes an axial shaft 10 connected at each end to a fitting 12 by a machine screw 14 threaded into a tapped hole 16 in the end of the shaft. A boss 18 on the end fitting is inserted into a shaft-end socket 20, both the boss and socket being concentric with the axis of rotation 22 of the roller 8. In a continuous casting machine the end fittings 12 may serve as rollers engaging marginal regions of a casting belt. These end fittings have mounting sockets 24 for engagement with suitable bearing elements as known in the art if continuous casting for enabling the roller 8 to rotate freely about its axis 22.

Figure 5:
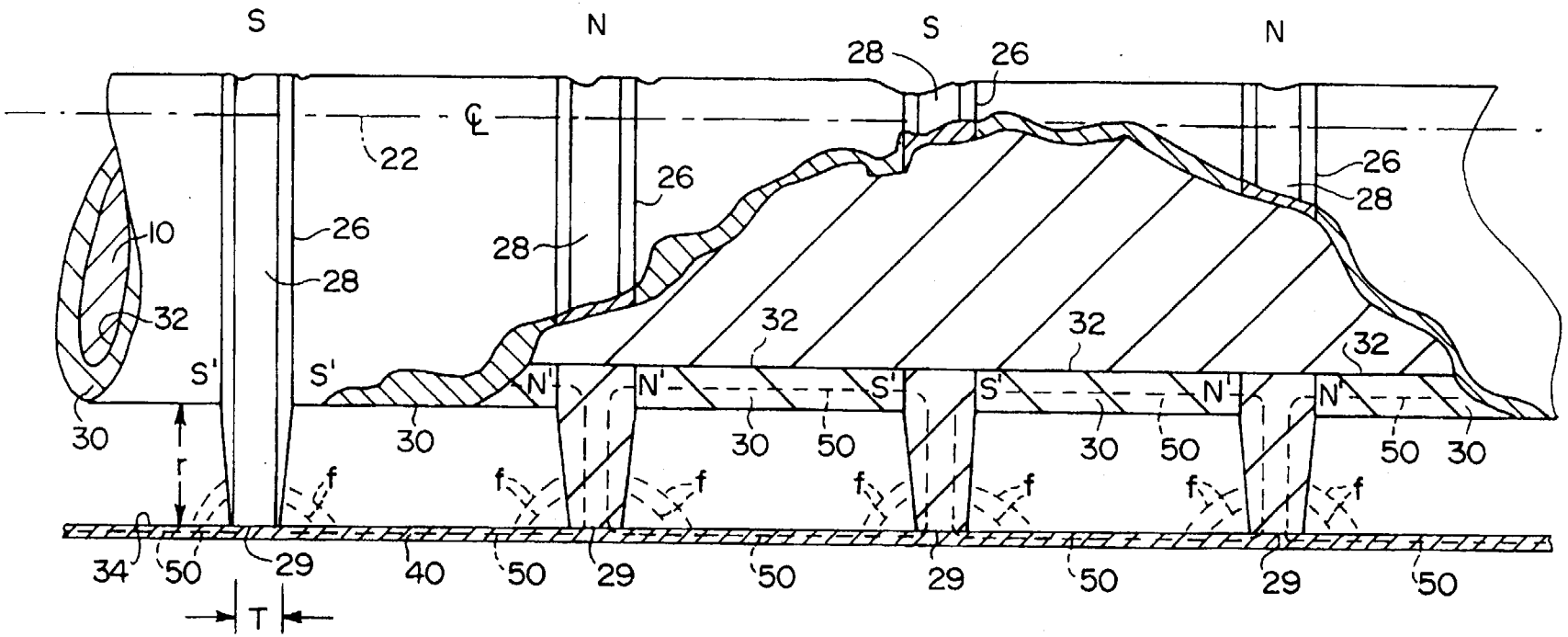
FIG. 5 is an enlarged view taken along line 5—5 in FIG. 4 illustrating a portion of a roller for showing magnetic circuits provided by a finned backup roller embodying the present invention acting in conjunction with a flexible, heat-conducting casting belt formed of magnetically soft ferromagnetic material.

A multiplicity of annular fins 26 formed of magnetically soft ferromagnetic material for example such as type 430 chromium stainless steel, are mounted on the shaft 10 at uniformly spaced intervals. For example, the center-to-center spacing of these fins along shaft 10 is preferred to be about 1 inch (about 25 millimeters) and may range up to about 1¼ inches (about 32 mm). These annular fins 26 are identical having a central opening 27 concentric with axis 22 and having an inside diameter (I.D.) depending upon shaft diameter being sized to fit snugly onto the shaft 10. The fins have a circular perimeter (rim) 28 (FIG. 3) concentric with axis 22, and this rim is flat, i.e., it has a circular cylindrical configuration with a rim thickness T (FIG. 5). For example in the illustrative embodiment shown the rim thickness T may be about 0.08 of an inch (about 2 mm). The fins are tapered being thinner at their rims and having a thicker body near their central opening 26. For example, the body of the fins as shown may have a thickness of about 0.18 of an inch (about 5 mm) near their central opening. The outside diameter (O.D.) of the rim 28 may be in a range of about 3.30 inches (about 84 mm) to about 4 inches (about 102 mm). In a more preferred embodiment as illustrated this rim O.D. is about 3.37 inches (about 85.6 mm).

On the shaft 10 between successive fins are mounted a multiplicity of reach-out permanent magnets 30. The shaft 10 and the end fittings 12 are all made of non-magnetic material, for example such as type 304 austenitic stainless steel. Each permanent magnet 30 is shaped as a hollow circular cylindrical collar having a circular cylindrical bore 32 with an inside diameter (I.D.) sized for fitting snugly onto the shaft 10. This shaft as shown may have a diameter in a range of about 2.30 inches (about 58 mm) to about 3 inches (about 76 mm) and in a more preferred embodiment as illustrated the shaft has a diameter of about 2.34 inches (about 59.4 mm). The outside diameter (O.D.) of these reach-out magnet collars 30 may be in a range of about 2.70 inches (about 68.6 mm) to about 3.44 inches (about 87 mm). These reach-out magnet collars as shown may have a wall thickness radially of at least about 0.2 of an inch (about 5 mm) and more preferably at least about 0.22 of an inch (about 5.6 mm). As shown these collars have an axial length at least about 0.8 of an inch (about 20 mm) and more preferably at least about 0.82 of an inch (about 20.8 mm).

Also, it is preferred that the rims 28 be spaced radially outwardly beyond the exterior surface of the collars 30 by a radial spacing "r" (FIGS. 3 and 5) of at least about ¼ of an inch (about 6 mm) and more preferably at least about 0.29 of an inch (about 7.4 mm) in order to provide sufficient clearance space between the exterior surface of the collars and the reverse surface 34 of a casting belt 40 for allowing cooling of the belt by applying suitable coolant flowing (not shown) along the reverse belt surface 34 as known in the art.

The moving, flexible, thin-gauge, heat-conducting casting belts 40 (FIGS. 4 and 5) are formed of magnetically soft ferromagnetic material; for example they are formed of metallic material such as quarter-hard-rolled low-carbon sheet steel.

In order to accommodate differences in thermal expansion of collars and fins relative to the shaft 10, a springy resilient device 36 is mounted somewhere along the shaft 10. Preferably this device 36 is mounted as is shown (FIG. 1) located between an end fitting 12 and a magnet collar 30 near the end of the shaft. For example, this springy device 36 may be a springy metallic washer such as a wave washer or a canted-coil garter spring or an elastomeric gasket.

Figure 4:
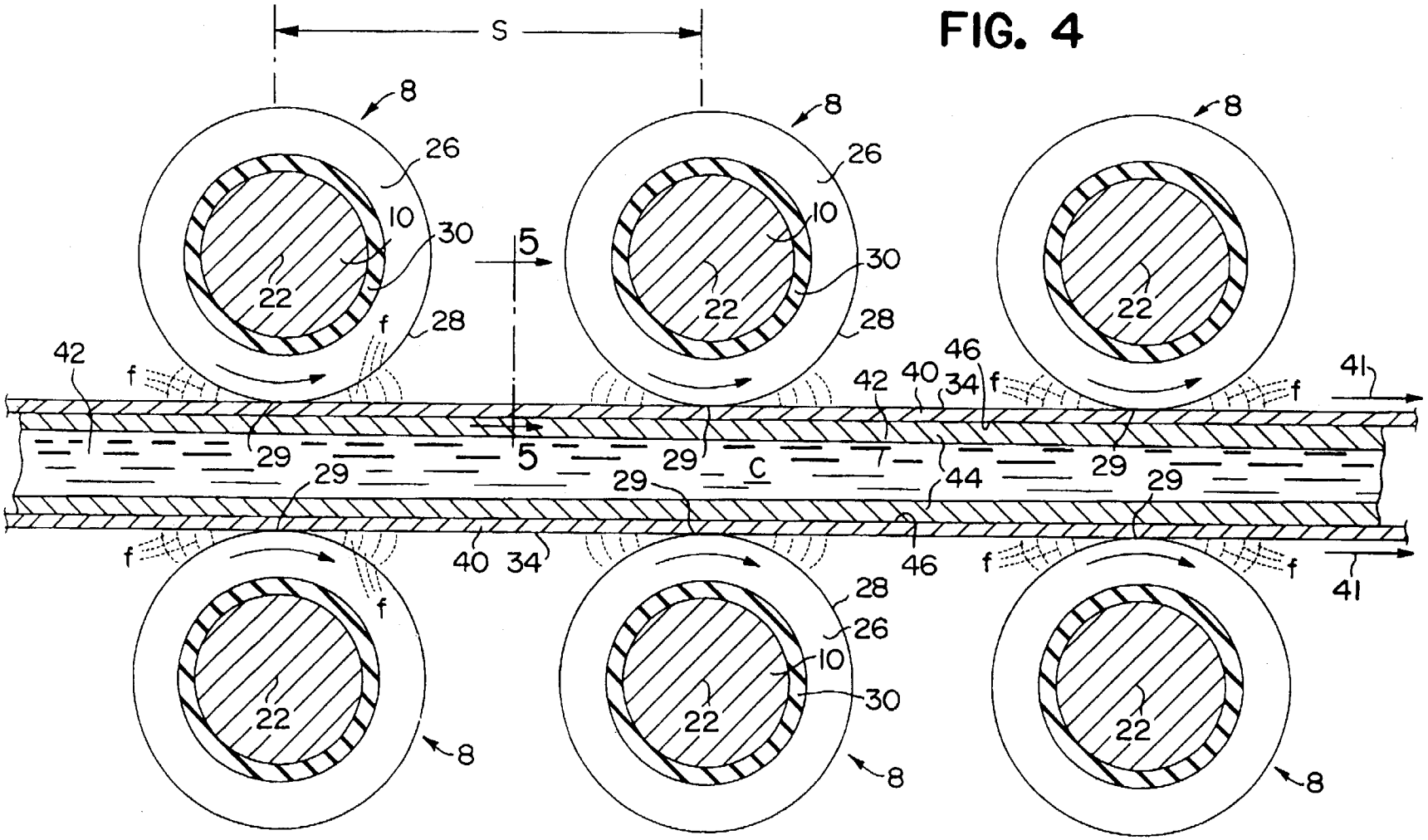
FIG. 4 is a side elevational sectional view through a portion of a moving mold cavity in a twin-belt continuous casting machine showing a plurality of finned backup rollers guiding and stabilizing upper and lower casting belts. Belt coolant application devices and the coolant itself are omitted from FIG. 4 and the cross-section of the rollers is enlarged relative to FIG. 3 for clarity of illustration.

In FIG. 4 is shown in sectional view a portion of a moving mold cavity C defined between a pair of spaced casting belts 40 which are moving in a downstream direction as shown by arrows 41. The belts are travelling from an entrance (not shown) into the mold cavity toward an exit therefrom (not shown). These two belts are supported and driven by a machine as known in the art, such a machine often being called a twin-belt continuous caster. The belts 40 are in rolling contact with rims 28 of fins 26 on a plurality of upper and lower backup rollers 8 which are guiding and stabilizing the upper and lower moving belts. The contact regions 29 in FIG. 4 are the small-area places where the reverse surface 34 of a moving belt is in tangential rolling contact with respective rims 28.

Within mold cavity C (FIG. 4) is shown molten metal 42, for example aluminum or an aluminum alloy. This molten metal is commencing to solidify in freezing layers 44 adjacent to front surfaces 46 of the belts. The rear surfaces 34 of the moving belts are being cooled by liquid coolant (not shown) in a manner known in the art. Such liquid coolant for example is water containing corrosion inhibitors as known in the art. It is noted that thicknesses of the freezing layers progressively increase in a downstream direction as increasing amounts of molten metal become solidified. The spacing S between neighboring roller axes 22, i.e., shaft center-to-center spacing, is preferred to be less than about 1¾ times the O.D. of fins 26 so that neighboring contact regions 29 in FIG. 4 are not spaced longitudinally along a moving belt by more than that spacing. Also, the O.D. of end fittings 12 (FIG. 1) is equal to the O.D. of the fins, so these end fittings may be in rolling contact along margins of a moving belt.

In FIG. 5 the dashed lines 50 indicate magnetic circuits which are energized by the reach-out magnets 30. Each of these magnetic circuits can be traced starting from a North pole N' of a permanent magnet 30 proceeding into a fin 26 and extending radially outwardly within the fin to a contact region 29 where the rim 28 is in rolling contact With the reverse surface 34 of the casting belt 40. Each circuit 50 extends from a first contact region 29 within the magnetically soft ferromagnetic belt 40 to a second contact region of a neighboring fin. Then each circuit 50 extends radially inwardly within the neighboring fin to a South pole S' of the magnet. Each magnetic circuit is completed within the magnet from its South pole S' to its North pole N'. It is noted that these reach-out collar magnets 30 are magnetized in a direction parallel with the axis 22. If these collar magnets are formed of material subject to corrosion, then they are suitably coated for resisting corrosion, for example being nickel plated.

The permanent magnetic material in each of the reach-out magnets 30 which powerfully magnetize the circuits 50 (FIG. 5) and also powerfully magnetize the whole of the fins 26 for providing powerful reach-out attraction forces (pull) on a moving casting belt 40 containing magnetically soft ferromagnetic material has certain very important critical characteristics: (1) A sample of this permanent magnetic material has a normal hysteresis loop (B-H loop) which crosses the B-axis at a point wherein the sample has a residual induction $B_r$ with a magnetic flux density equal to or greater than about 8,000 Gauss. (2) A sample of this permanent magnetic material has a normal hysteresis loop (B-H loop) wherein a straight line tangent to a midpoint of the portion of the loop in the second or fourth quadrant has a slope indicating a midpoint differential demagnetizing permeability in ΔGauss per ΔOersted equal to or less than about 4 with the magnetic permeability of air, coolant water, or vacuum being taken as 1. Also, this permanent magnetic material needs to have a great degree of permanence—i.e., roughly speaking it needs to be hard to demagnetize, i.e., it is "hard" in a magnetic sense, i.e., a very large demagnetizing coercive force is required in order to demagnetize this permanent magnetic material.

As used herein the term "midpoint differential demagnetizing permeability" of a sample of a permanent magnetic material means the slope expressed in ΔGauss per ΔOersted of a straight line which is tangent to the sample's B-H loop at a midpoint of the portion of this loop which is in the second or fourth quadrant. It is to be understood that the sample's B/H loop is drawn on a plot wherein values of B and H are scaled along the respective vertical and horizontal axes such that B/H or ΔB/ΔH of vacuum, i.e., the slope for the flux density B resulting from applying a coercive force H to vacuum when on this same plot is always 1; in other words, the ratio of the change in flux density ΔB to a change ΔH in applied coercive force for vacuum when drawn on this same plot is always 1. In the following tables we have set forth our preferences in regard to these important critical characteristics.

TABLE I

| A sample of permanent magnetic material in magnets 32 has a B-H loop which crosses the B-axis at a point where the residual induction $B_r$ has a magnetic flux density in Gauss: | |
|---|---|
| generally | equal to or greater than 8,000 |
| preferred | equal to or greater than about 9,000 |
| more preferred | equal to or greater than about 10,000 |
| most preferred | above about 11,000 |

TABLE II

| A sample of permanent magnetic material in magnets 32 has a midpoint differential demagnetizing permeability expressed in ΔGauss per ΔOersted | |
|---|---|
| preferred | equal to or less than about 4 |
| more preferred | equal to or less than about 2.5 |
| most preferred | equal to or less than about 1.2 |

In aiding relationship to the magnetic attraction force pulling a belt toward rims 28 at contact regions 29 provided by flux in the magnetic circuits 50 passing through these rim-contact regions 29, the reach-out magnets 30 have unique characteristics suitable for providing additional flux indicated by pluralities of dashed lines f (FIGS. 4 and 5) which passes through air and/or coolant water (not shown) and enters a belt at multiple locations which are offset from contact regions 29. This additional reach-out flux f applies additional magnetic attraction force to a belt pulling it toward the rims 28. It is to be understood from considering both of FIGS. 4 and 5 that this reach-out flux f extends outwardly from rims of the fins and from tapering side surfaces of the fins toward the belt being guided and stabilized thereby in a three-dimensional pattern extending upstream and downstream (FIG. 4) and also includes extending laterally from each fin toward both left and right (FIG. 5).

We envision that any permanent magnets 30 made of permanent magnetic material exhibiting the very important critical characteristics described above are capable of successful performance in the disclosed embodiments of the invention. We prefer to use collar magnets 30 containing permanent magnetic materials commercially known as rare earth magnetic materials for example such as magnets comprising magnetic materials including at least one of the "rare earth" chemical elements (lanthanide family series of chemical elements numbered 57 to 71), for example magnets preferably containing permanent magnetic materials comprising the rare earth chemical elements neodymium or samarium. For example, magnets containing a permanent magnetic material comprising a compound of cobalt and samarium ($Co_5Sm$) having a maximum energy product of about 20 MGOe (Mega-Gauss-Oersteds) may be used since its B-H hysteresis loop has a residual induction $B_r$ of about 9,000 gauss, and magnets containing $Co_{17}Sm_2$ material having a maximum energy product in a range of about 22 to about 28 MGOe may be used for its B-H loop has a residual induction $B_r$ in a range of about 9,000 gauss to about 11,000 gauss.

$Co_5Sm$ permanent magnetic material having a maximum energy product of about 20 MGOe has a midpoint differential demagnetizing permeability of about 1.08. $Co_{17}Sm_2$ permanent magnetic materials having maximum energy products in a range of about 22 to about 28 MGOe have a midpoint differential demagnetizing permeability in a range of about 1.15 to about 1.0.

Our presently most preferred permanent magnets 30 contain a permanent magnetic material based on a tri-element (ternary) compound of iron, neodymium, and boron known generically as neodymium-iron-boron, Nd-Fe-B or NdFeB, which exhibits a maximum energy product in a range of about 25 to about 35 MGOe. Such magnets may be called "neo magnets", with about 32 to about 35 MGOe neo magnets presently being most preferred. NdFeB permanent magnetic material having a maximum energy product in the range of about 25 to about 35 MGOe have a B-H loop with a residual induction $B_r$ in a range of about 10,700 Gauss to about 12,300 Gauss and have a midpoint differential demagnetizing permeability of about 1.15. Neo magnets do have a low resistance to corrosion and so they are nickel-plated.

We envision that in the future other permanent magnetic materials for example ternary compounds such as iron-samarium-nitride and other as yet unknown ternary compound permanent magnetic materials and as yet unknown four-element (quaternary) permanent magnetic materials may become commercially available and may have B-H loops with a residual induction $B_r$ sufficiently high as shown in Table I and also may exhibit midpoint differential demagnetizing permeability sufficiently low to be suitable as shown in Table II for use in embodiments of this invention.

Although specific presently preferred embodiments of the invention have been disclosed herein in detail, it is to be understood that these examples of the invention have been described for purposes of illustration. This disclosure is not intended to be construed as limiting the scope of the invention, since the described apparatus may be changed in detail, or to equivalent permanent magnetic materials, by those skilled in the art of continuous casting, in order to adapt these apparatuses and methods for keeping flat with suitable evenness a revolving, endless, flexible, heat-conducting casting belt containing magnetically soft ferromagnetic material and operating in a continuous-casting machine during the continuous casting of metal, in order further to be useful in various particular belt-type continuous casting machines or various belt-type caster installation situations, without departing from the scope of the following claims.

We claim:

1. An elongated finned backup roller for guiding an endless, flexible, heat-conducting casting belt containing magnetically soft ferromagnetic material, said elongated finned backup roller comprising:

a multiplicity of fins each having a circular circumference concentric with an axis of rotation of the roller;

said fins being formed of magnetically soft ferromagnetic material and being located at positions spaced axially along the roller;

a multiplicity of reach-out permanent magnets each having a residual induction equal to at least about 9,000 Gauss and each having a midpoint differential demagnetizing permeability equal to or less than about 4 ΔGauss/ΔOersted; and said magnets being included in the roller magnetizing said fins with their circumferences having alternate North and South magnetic polarities along the roller.

2. An elongated finned backup roller claimed in claim 1, in which:

said reach-out permanent magnets are formed of a material generically known as neodymium-iron-boron having a residual induction of at least about 10,700 Gauss.

3. An elongated finned backup roller claimed in claim 1 including:

a non-magnetic shaft concentric with said axis; and said fins and magnets being mounted on said shaft at positions spaced axially along the shaft.

4. An elongated finned backup roller claimed in claim 3, in which:

said reach-out permanent magnets are mounted on the shaft between the fins, with at least one magnet being positioned between neighboring fins.

5. An elongated finned backup roller claimed in claim 4, in which:

said reach-out permanent magnets encircle the shaft between neighboring fins;

said reach-out permanent magnets are magnetized in a direction parallel with the axis having North and South magnetic poles at opposite axial ends of each magnet; and magnetic poles of like polarity face toward opposite sides of fins.

6. An elongated finned backup roller claimed in claim 5, in which:

said reach-out permanent magnets are formed of a material generically known as neodymium-iron-boron having a residual induction of at least about 10,700 Gauss; and said reach-out permanent magnets have a length of at least about 0.8 of an inch (about 20 mm).

7. An elongated finned backup roller claimed in claim 5, in which:

said reach-out permanent magnets are collars having bores fitting onto the non-magnetic shaft; and said fins are annular in configuration and have central openings fitting onto the non-magnetic shaft with each fin being positioned between successive reach-out permanent magnet collars.

8. An elongated finned backup roller claimed in claim 7, in which:

an end fitting is attached to each end of the shaft for holding the reach-out permanent magnet collars and the fins on the shaft;

one of said reach-out permanent magnet collars is adjacent to each of the end fittings;

the end fittings are made of non-magnetic material; and a resilient device is positioned adjacent to an end of one of the reach-out permanent magnet collars for accommodating differences in thermal expansion of the reach-out permanent magnet collars and the fins relative to the shaft.

9. An elongated finned backup roller claimed in claim 5, in which:

said reach-out permanent magnet collars have a wall thickness radially of at least about 0.2 of an inch (about 5 mm); and said reach-out permanent magnet collars have an axial length of at least about 0.8 of an inch (about 20 mm).

10. An elongated finned backup roller claimed in claim 9, in which:

said reach-out permanent magnet collars are formed of permanent magnet material having a residual induction equal to at least about 10,000 Gauss; and said permanent magnet material has a midpoint differential demagnetizing permeability whose maximum value does not exceed about 2.5 ΔGauss per ΔOersted.

11. An elongated finned backup roller claimed in claim 9, in which:

the circular circumferences of said fins are spaced radially outwardly from said reach-out permanent magnet collars by a distance "r" of at least about ¼ of an inch (about 6 mm).

12. An elongated finned backup roller for guiding an endless, flexible, heat-conducting casting belt containing magnetically soft ferromagnetic material said finned backup roller comprising:

an elongated, rotatable non-magnetic shaft having an axis of rotation;

a multiplicity of annular fins of magnetically soft ferromagnetic material each having a circular rim and each having an opening therethrough concentric with the rim and sized for fitting onto the shaft;

a multiplicity of reach-out permanent magnets;

said magnets being configured as collars each having a bore therethrough sized for fitting onto the shaft and each being magnetized parallel with the bore for providing each collar with North and South magnetic poles it its opposite ends;

said collars and fins being assembled on the shaft alternating in sequence with same polarity magnetic poles adjacent to opposite sides of each fin for magnetizing the fins; and said fins projecting radially outwardly beyond the collars and having alternate North and South magnetic polarities along the roller.

13. An elongated finned backup roller claimed in claim 12, in which:

an end fitting is connected to each end of the shaft concentric with the shaft for holding the collars and fins on the shaft;

the end fittings are made of non-magnetic material; and a resilient device encircles the shaft adjacent to an end of a collar for accommodating differences in thermal expansion of the collars and the fins relative to the shaft.

14. An elongated finned backup roller claimed in claim 13, in which:

the reach-out permanent magnet collars have residual induction equal to at least about 9,000 Gauss; and the reach-out permanent magnet collars have midpoint differential demagnetizing permeability whose maximum value is not greater than about 2.5 ΔGauss per ΔOersted.

15. An elongated finned backup roller claimed in claim 12, in which:

the reach-out permanent magnet collars have residual induction equal to at least about 9,000 Gauss; and the reach-out permanent magnet collars have midpoint differential demagnetizing permeability with a maximum value not exceeding about 4 ΔGauss per ΔOersted.

16. An elongated finned backup roller claimed in claim 12, in which:

said reach-out permanent magnet collars have axial lengths equal to at least about 0.8 of an inch; and said reach-out permanent magnet collars are neo magnets having residual induction of at least about 10,700 Gauss.

17. An elongated finned backup roller for guiding an endless, flexible, heat-conducting casting belt containing magnetically soft ferromagnetic material, said elongated finned backup roller comprising:

an elongated, rotatable non-magnetic shaft having an axis of rotation;

a multiplicity of annular fins of magnetically soft ferromagnetic material each having a circular rim and each having a central opening therethrough concentric with the rim and sized for fitting onto the shaft;

a multiplicity of reach-out permanent magnet collars each having a bore therethrough sized for fitting onto the shaft;

said reach-out permanent magnet collars each being magnetized parallel with the bore providing North and South magnetic poles at opposite ends of each collar;

said reach-out permanent magnet collars and said annular fins being assembled onto the shaft alternating in sequence with same polarity magnet poles being adjacent to opposite sides of each annular fin for magnetizing the fins;

said annular fins being thicker near their central openings than at their rims; and said annular fins projecting radially outwardly beyond the reach-out permanent magnet collars and being magnetized with alternate North and South magnetic polarities along the roller.

18. An elongated finned backup roller claimed in claim 17, in which:

said annular fins have a thickness adjacent to the magnet poles of the reach-out permanent magnet collars which is more than twice the thickness of their rims.

19. An elongated finned backup roller claimed in claim 18, in which:

said annular fins projecting radially outwardly at least about ¼ of an inch (about 6 mm) beyond the reach-out permanent magnet collars.

20. An elongated finned backup roller claimed in claim 17, in which:

said reach-out permanent magnet collars have a residual induction equal to at least about 10,000 Gauss; and said reach-out permanent magnet collars have a midpoint differential demagnetizing permeability equal to no more than about 2.5 ΔGauss per ΔOersted.

* * * * *